United States Patent [19]

Bleckmann et al.

[11] Patent Number: 4,569,286

[45] Date of Patent: Feb. 11, 1986

[54] APPARATUS FOR CLOSING THE GAP BETWEEN THE ENDS OF A GRAVURE PRINTING PLATE CLAMPED ON A FORME CYLINDER

[75] Inventors: Gerhard Bleckmann, Lampertheim-Rosengarten; John Lynch, Monsheim, both of Fed. Rep. of Germany

[73] Assignee: BASF Aktiengesellschaft, Fed. Rep. of Germany

[21] Appl. No.: 691,853

[22] Filed: Jan. 16, 1985

[30] Foreign Application Priority Data

Jan. 18, 1984 [DE] Fed. Rep. of Germany ..... 3401501

[51] Int. Cl.[4] ..... B41F 27/06; F16J 15/16

[52] U.S. Cl. ..... 101/382 R; 101/415.1; 101/DIG. 12; 277/9.5

[58] Field of Search ..... 101/382 R, 383, 415.1, 101/DIG. 12; 277/1, 9.5, 237

[56] References Cited

U.S. PATENT DOCUMENTS

| | | | |
|---|---|---|---|
| 3,261,262 | 7/1966 | Hilfing et al. | 277/1 X |
| 3,353,481 | 11/1967 | Antonucci | 101/382 R |
| 3,358,598 | 12/1967 | Middleton | 101/378 |
| 4,031,838 | 6/1977 | Schmidt et al. | 277/1 X |
| 4,343,011 | 8/1982 | Murray et al. | 101/415.1 |
| 4,515,378 | 8/1988 | Bleckmann et al. | 101/415.1 |

*Primary Examiner*—E. H. Eickholt

*Attorney, Agent, or Firm*—Keil & Weinkauf

[57] ABSTRACT

The gap formed between the end sections of a gravure printing plate anchored in a groove in a forme cylinder is covered with a plate, and the resulting gap cavity is filled with plastic, curable material. When the filling has been cured, the plate is removed. In order to position the plate exactly on the gap, the plate is held, in such a way that it can be rotated and lowered, by means of a pair of guide rails mounted on the forme cylinder axle; the said pair of rails can be connected to a means for centering on the gap, this means likewise being rotatable about the said axle.

7 Claims, 6 Drawing Figures

Figure 3:
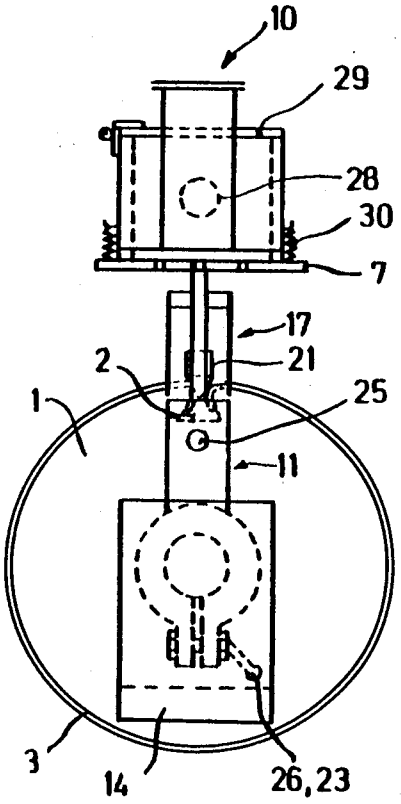

APPARATUS FOR CLOSING THE GAP BETWEEN THE ENDS OF A GRAVURE PRINTING PLATE CLAMPED ON A FORME CYLINDER

The present invention relates to an apparatus for closing the gap between the ends of a gravure printing plate clamped on a forme cylinder, comprising a plate which covers the gap and means for filling the gap cavity with plastic curable material.

It is known that gravure printing plates consisting of a dimensionally stable and flexible base and, applied on this, a printing layer, can be clamped on a forme cylinder of a sheet-fed or rotary gravure printing press. To do this, the forme cylinder is provided with a groove which runs parallel with or obliquely to the forme cylinder axle, and in which the gravure printing plate is hooked with ends bent over through an acute angle and is held firmly, as described in, for example, Patent Application Nos. P 30 49 143.1 and P 32 21 206.2. The resulting gap between the two ends of the gravure printing plate is closed with a plastic material. To do this, a fluid and curable material is introduced into the gap after the latter has been covered with a sheet-like element, e.g. a plate, by means of a pressure piece (Patent Application No. P 33 08 807.1). Although this results in a continuous uniform surface, without projections or depressions, in the region of the plate ends, it does not ensure an exact continuation of the forme cylinder surface. This depends on precise positioning of the plate in relation to the gap.

It is an object of the present invention to provide an apparatus for closing the gap between the ends of a gravure printing plate clamped on a forme cylinder, with which apparatus the plate covering the gap can be aligned exactly with the latter.

We have found that this object is achieved, in accordance with the invention, by an apparatus of the type described at the outset, comprising a plate holder which is rotatable in the region of the gap and is intended for positioning the plate exactly in relation to the gap, the holder consisting of a pair of guide rails which are rotatably mounted on the axle of the forme cylinder and can be fixed, and which possess guides which run radially with respect to the axle and are intended for accepting a holding bar to whose lower side the plate is elastically fastened and which can be moved toward the forme cylinder manually or by means of a drive, and a centering means for the holder, which means can be aligned with the gap.

In an advantageous embodiment, the plate covering the gap is transparent.

In another embodiment, the centering means consists of a radiation source which is located above the transparent plate and directed toward the forme cylinder surface.

Moreover, the centering means can consist of a centering bar which can be inserted into guides in the guide rails and can be moved therein, and which has a cross-section which is wedge-shaped toward the gap.

In a particularly advantageous embodiment, the centering means consists of a pair of centering rails which are likewise rotatably mounted on the axle of the forme cylinder directly adjacent to the pair of guide rails and which can be fixed and possess guides which also run radially with respect to the axle and in which a centering bar which is wedge-shaped toward the gap can be moved therein under its own weight or by means of spring force, thereby adjusting the pair of rails to the radius corresponding to the middle of the gap, and the pair of centering rails subsequently to be fixed and the pair of guide rails to be swiveled over these can be fixed to one another through superimposed holes by means of one pin in each case in order to center the pair of guide rails, and can then be detached from one another once again by removing the pin to permit the pair of centering rails to be swung back.

In a further embodiment of the invention, instead of being provided with the guides and the wedge-shaped centering bar, the pair of centering rails can be equipped with a radiation source directed toward the forme cylinder surface.

In another embodiment of the novel apparatus, a radiation source which is effective toward the gap cavity and extends along its entire length is rotatably held on the holding bar for the plate.

An example is described below with reference to the drawing in order to provide a clearer illustration of the invention.

Figure 1:
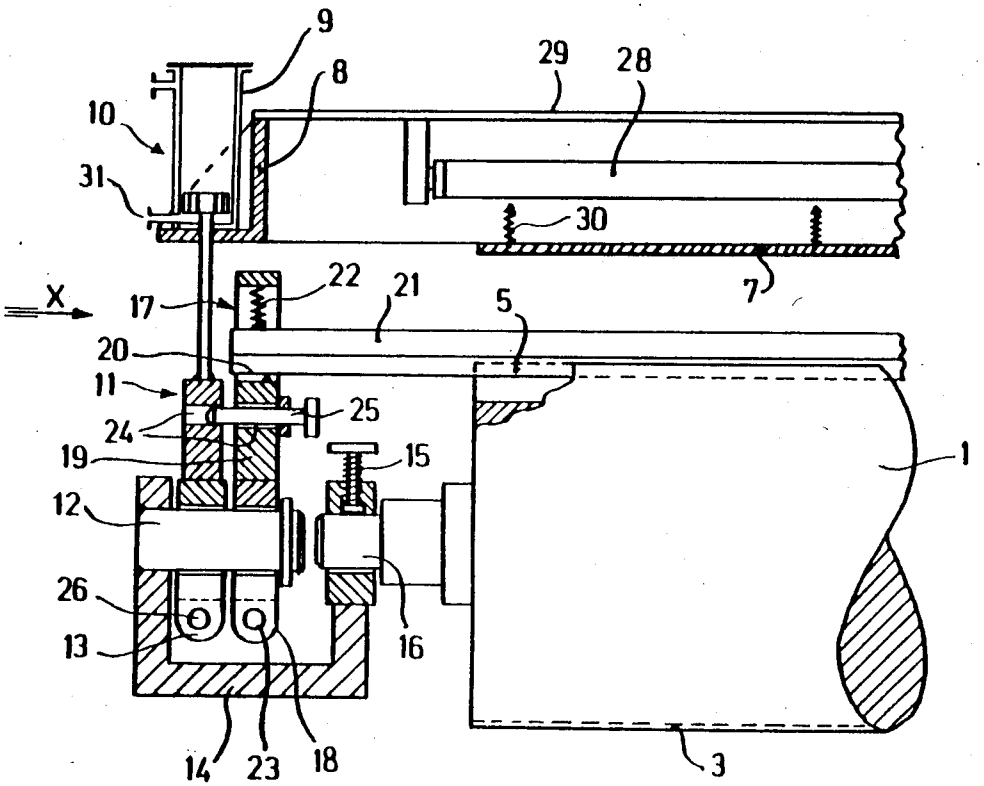
Figure 4:
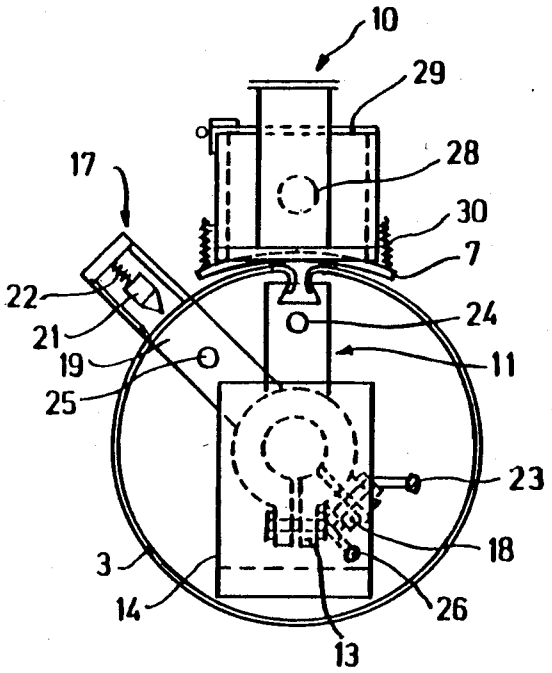
Figure 2:
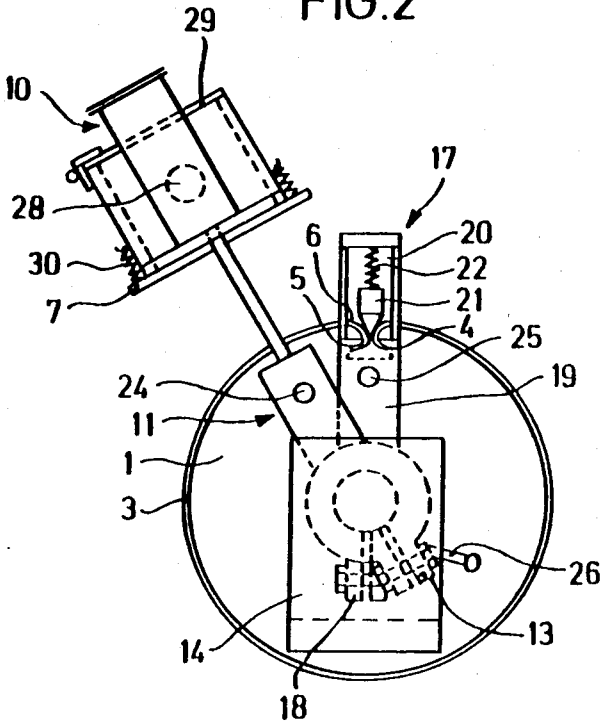
Figure 5:
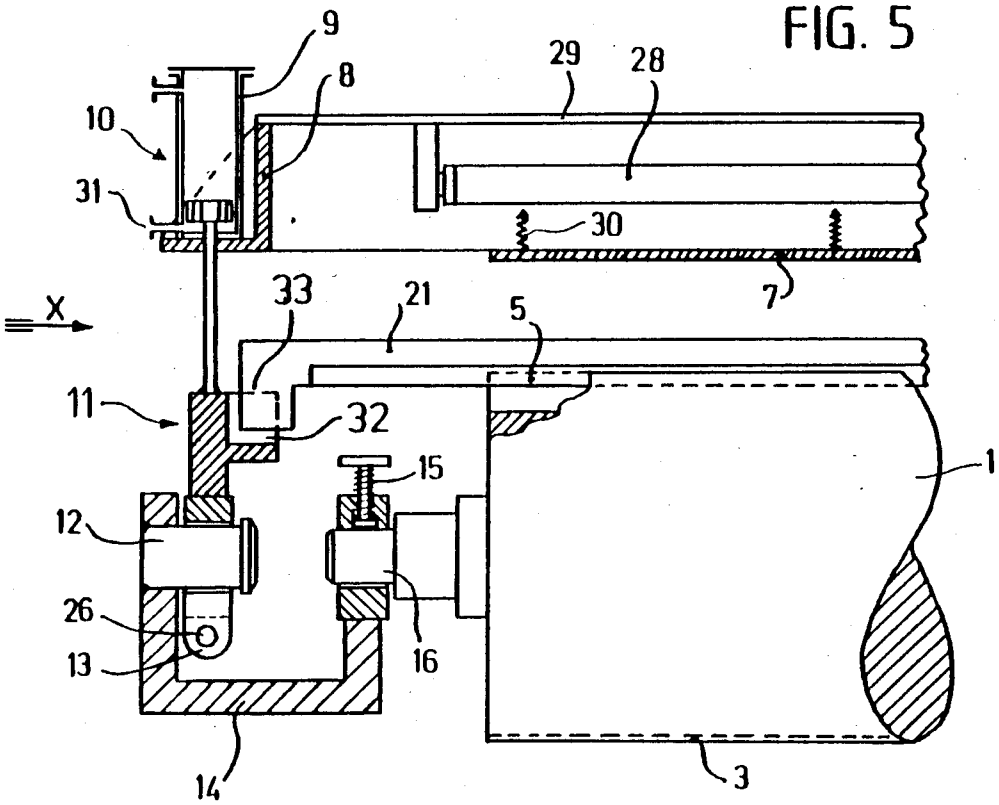
Figure 6:
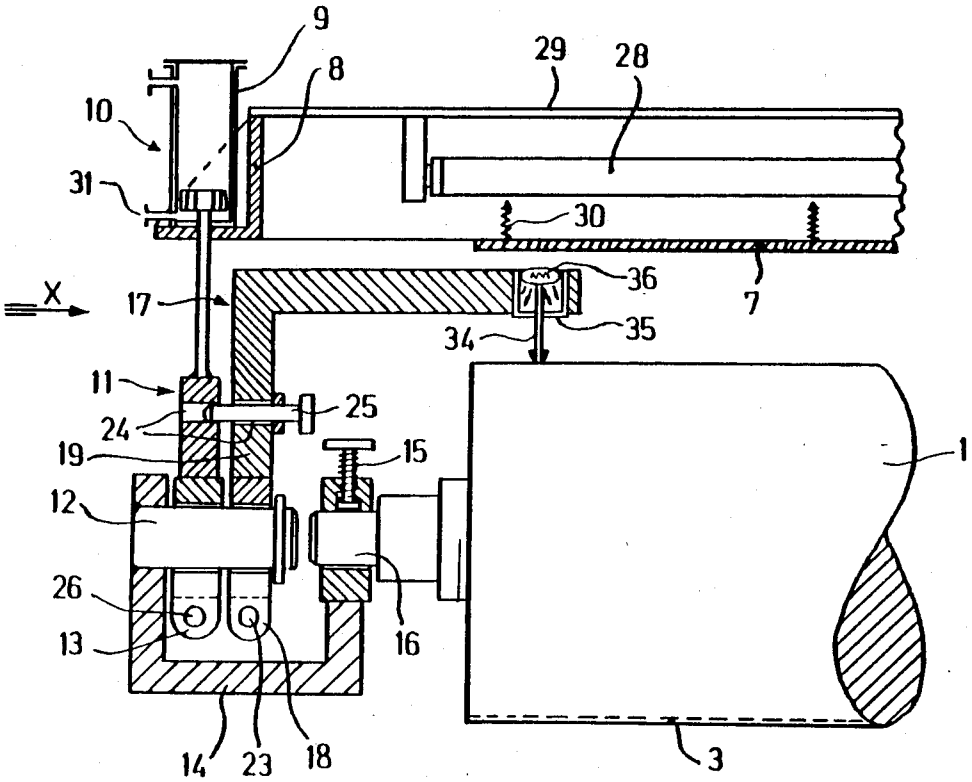

FIG. 1 shows a partial view of a longitudinal section of the forme cylinder with the novel apparatus for closing the gap, FIGS. 2–4 show the forme cylinder with the apparatus, viewed in the X direction in FIG. 1, in successive operating positions, and FIGS. 5 and 6 show the forme cylinder and the apparatus for closing the gap, with various embodiments of the centering means.

As can be seen in FIGS. 1 and 2, the forme cylinder 1 of a sheet-fed or rotary gravure printing press is provided with a groove 2 which runs along the forme cylinder axle and widens from the cylinder surface to the cylinder center, and in which the gravure printing plate 3 clamped on the forme cylinder is hooked with both ends 4, these being bent over through an acute angle. To close the gap 5 between the two ends, a plate 7 which extends over the two end sections 6 of the gravure printing plate is placed in position, the said plate 7 being elastically fastened to the underneath of a box-shaped holding bar 8 by means of rubber or spring rings 30 and being flexible or being shaped to correspond to the contour of the cylinder surface.

The holding bar 8 is fastened to the mobile cylinder housing 9 of a pneumatic working cylinder 10, whose piston, which is connected to a guide rail 11, is fixed. Accordingly, the working cylinder is the guide and at the same time the drive organ for the plate 7 to be driven onto the forme cylinder 1 by means of the holding bar. The plate holder of this type is present opposite both ends of the forme cylinder and is shown in the drawing for only one end.

For positioning the plate 7 with respect to the gap 5 to be covered, the guide rail 11 is rotatably mounted on the axle of the forme cylinder or on an axle 12 coaxial with this, and can be fixed by means of a collar 13. In the example shown in FIG. 1, the axle is held in a U-shaped limb 14 which is fixed to the shaft end 16 of the forme cylinder 1 by means of a fixing screw 15.

Before the plate 7 is placed on the forme cylinder surface, the plate has to be aligned on the gap 5. For this purpose, a centering means 17 is provided which consists of a pair of centering rails 19 which are likewise rotatably mounted on the axle 12, can be fixed by means of a collar 18 and possess recesses 20 running radially with respect to the axle and, held therein without any play, a centering bar 21 which extends over the entire length of the forme cylinder and is wedge-shaped toward the gap 5. As shown in FIG. 2, the centering bar is lowered manually into the gap 5, after which it is pressed into the said gap by its own weight or with the aid of springs 22 supported on the two centering rails. The pair of centering rails is drawn to the radius corresponding to the middle of the gap, providing of course that the recesses 20 serving as guides are located exactly on the center line of the rails, and is then fixed by means of the locking screws 23 and the collars 18. The pair of centering rails is thus an aid for aligning the pair of guide rails 11 which are located directly adjacent and embrace this pair of centering rails. The said pair of guide rails are then swung into the same position as the pair of centering rails (FIG. 3) and are fixed to this by pins 25 through superimposed holes 24, so that the pair of guide rails are brought into alignment. By clamping the collars 13 by means of the locking screws 26, the guide rails are then fixed; when the pins 25 have been removed and the collars 18 released, the centering bar 21 is lifted and the centering rails swung back again (FIG. 4), so that the plate 7, which is now exactly positioned, can be lowered onto the gap 5 of the forme cylinder 1 by actuating the working cylinder 10. With the aid of the pressure medium fed via the nozzle 27 to the cylinder housing 9, the contact pressure of the plate on the end sections 6 of the gravure printing plate 3 can be adjusted so that on the one hand it is sufficient to seal the gap 5 against the pressure of the filling material in the gap cavity, and on the other hand deformation of the contact surfaces is avoided. In this procedure, the plate is elastically deformed, its curvature corresponding to that of the forme cylinder surface.

In another embodiment of the novel apparatus (FIG. 5), the wedge-shaped centering bar 21 runs in the guide rails 11 for the holding bar 8, so that the pair of centering rails 19 can be dispensed with. For this purpose, each guide rail is provided with an additional guide 32 which runs radially with respect to the forme cylinder axle and into which the centering bar can be inserted via a lateral projection 33, and from which it can be removed once again before the plate 7 is lowered.

In another embodiment of the apparatus (FIG. 6), the centering means consists of a radiation source which is directed toward the forme cylinder surface and produces a focussed light beam 34, for example laser optics or a perforated mask 35 above which a light source 36 is located, the said radiation source being fastened, instead of the centering bar 21, to a support connecting the centering rails 19, or above the plate 7, to the holding bar 8. In the latter arrangement, the plate 7 has to be transparent. This also has the advantage that the procedure for filling the gap 5 and the tightness between the plate and its contact surfaces can be observed.

In order to cure photocurable filling materials, a radiation source 28, for example a fluorescent tube, is held rotatably on the holding rail 8 for the plate 7 by means of an articulated holder 29. When the filling procedure is complete, the radiation source which extends along the entire length of the gap 5 is rotated above the transparent plate and is hence effective in the direction of the gap.

The surface which connects the two end sections 6 of the gravure printing plate 3 and is formed in the manner described above can be used without any subsequent processing, so that when the holder for the plate 7 has been swung back the forme cylinder 1 can be removed and used in the printing press.

We claim:

1. Apparatus for closing the gap between the ends of a gravure printing plate clamped on a forme cylinder, comprising a plate which covers the gap, means for filling the gap cavity with plastic, curable material, a plate holder which is rotatable in the region of the gap and is intended for positioning the plate exactly in relation to the gap, the holder consisting of a pair of guide rails which are rotatably mounted on the axle of the forme cylinder and can be fixed, and which possess guides which run radially with respect to the axle and are intended for accepting a holding bar to whose lower side the plate is elastically fastened and which can be moved toward the forme cylinder manually or by means of a drive, and a centering means for the holder, which means can be aligned with the gap.

2. Apparatus as claimed in claim 1, wherein the plate covering the gap is transparent.

3. Apparatus as claimed in claim 1, wherein the centering means consists of a radiation source which is located above the transparent plate and directed toward the forme cylinder surface.

4. Apparatus as claimed in claim 1, wherein the centering means consists of a centering bar which can be inserted into guides in the guide rails and can be moved therein, and which has a cross-section which is wedge-shaped toward the gap.

5. Apparatus as claimed in claim 1, wherein the centering means consists of a pair of centering rails which are likewise rotatably mounted on the axle of the forme cylinder directly adjacent to the pair of guide rails and which can be fixed and possess guides which also run radially with respect to the axle and in which a centering bar which is wedge-shaped toward the gap can be moved therein under its own weight or by means of spring force, thereby adjusting the pair of rails to the radius corresponding to the middle of the gap, and the pair of centering rails subsequently to be fixed and the pair of guide rails to be swiveled over these can be fixed to one another through superimposed holes by means of one pin in each case in order to center the pair of guide rails, and can then be detached from one another once again by removing the pin to permit the pair of centering rails to be swung back.

6. Apparatus as claimed in claim 1, wherein the pair of centering rails, instead of being provided with the guides and the wedge-shaped centering bar, is equipped with a radiation source directed toward the forme cylinder surface.

7. Apparatus as claimed in claim 1, wherein a radiation source which is effective toward the gap cavity and extends along its entire length is rotatably held on the holding bar for the plate.

* * * * *